United States Patent [19]

St. Clair

[11] 4,223,487

[45] Sep. 23, 1980

[54] ROOF CONSTRUCTION AND METHOD OF MAKING THE SAME

[76] Inventor: Alfred L. St. Clair, 1103 Monroe St., Rochester, Ind. 46975

[21] Appl. No.: 4,377

[22] Filed: Jan. 18, 1979

[51] Int. Cl.[3] ..... E04D 13/00

[52] U.S. Cl. ..... 52/11; 52/90; 52/94; 52/309.2; 52/309.8; 52/262

[58] Field of Search ..... 52/11, 90, 94, 565, 52/506, 511, 512, 587, 483, 39, 262, 309.2, 309.8

[56] References Cited

U.S. PATENT DOCUMENTS

| | | | |
|---|---|---|---|
| 739,646 | 9/1903 | Carter | 52/587 |
| 2,357,637 | 9/1944 | Drypolcher | 85/17 |
| 2,580,231 | 12/1951 | Lamm | 52/513 |
| 3,207,211 | 9/1965 | Winterfeldt | 52/11 |
| 3,236,014 | 2/1966 | Edgar | 52/92 |
| 3,415,019 | 12/1968 | Andersen | 52/94 |
| 3,426,488 | 2/1969 | Stanford | 52/536 |
| 3,605,356 | 9/1971 | Bordner | 52/11 |
| 3,909,998 | 10/1975 | Simpson et al. | 52/536 |

FOREIGN PATENT DOCUMENTS

| | | | |
|---|---|---|---|
| 642346 | 3/1937 | Fed. Rep. of Germany | 52/309.2 |

OTHER PUBLICATIONS

A. Renfrew & Phillip Morgan, Polythene, The Technology and Uses of Ethylene Polymers London, Iliffe & Sons, Ltd., 1963, pp. 397–405, 543.

*Primary Examiner*—James L. Ridgill, Jr.
*Attorney, Agent, or Firm*—Oltsch, Knoblock & Hall

[57] ABSTRACT

A roof construction utilizing thermoplastic panels and a method of making the same. The thermoplastic panels are arranged in edge contacting relation to span a roof underpanel supported by a roof frame. The thermoplastic panels carry anchor members projecting through openings in the underpanel and secured to the frame. The thermoplastic panels are bonded together at their margins. The thermoplastic panels at the roof margins have downturned flanges. Gutters have flanges which underlie and are anchored to the marginal panels at building eaves.

The method involves formation of spaced openings in the roof underpanel adjacent to roof frame members to receive thermoplastic anchor strips whose upper ends contact the thermoplastic panels to be bonded thereto by the application of heat to the panel part contacted by the anchors. The lower ends of the anchors are secured to the frame members. The marginal portions of the thermoplastic panels project beyond the edges of the underpanel and are heated and downturned alongside the edges of the underpanel.

9 Claims, 12 Drawing Figures

Fig. 8
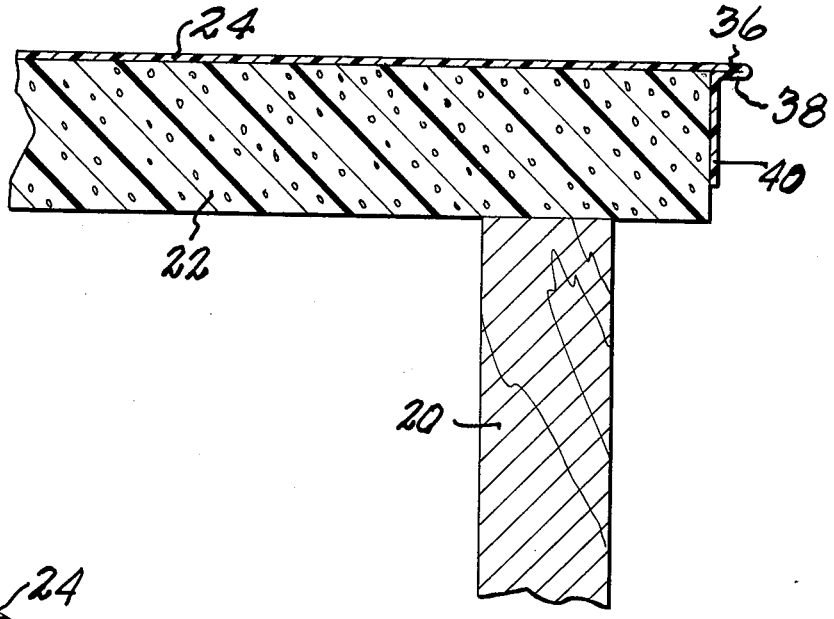
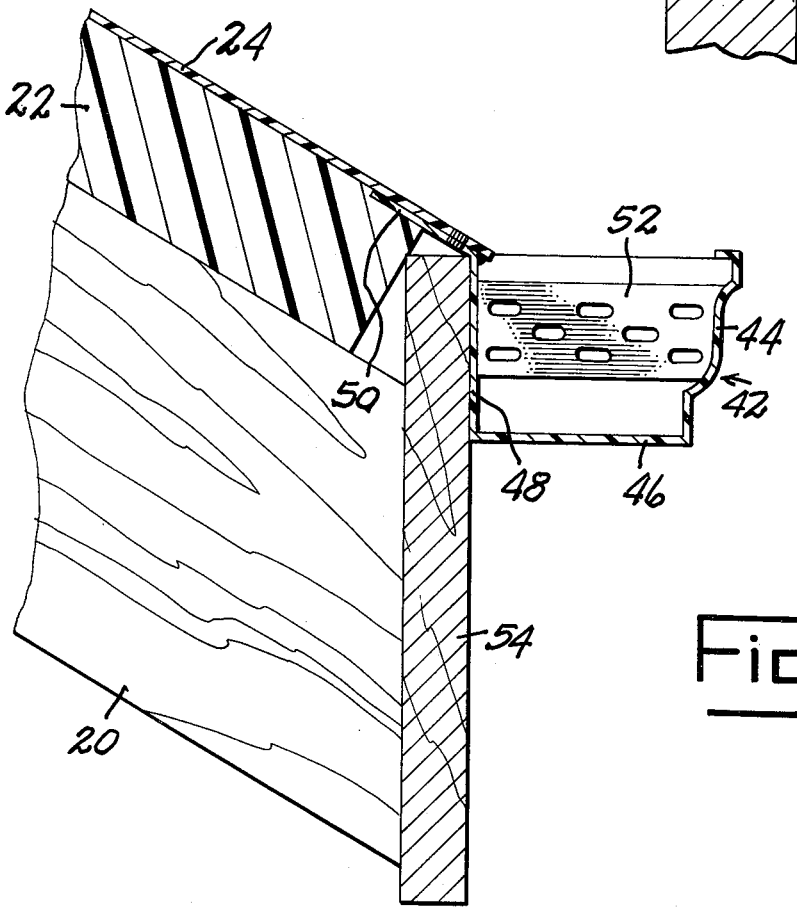
Fig. 9

ROOF CONSTRUCTION AND METHOD OF MAKING THE SAME

SUMMARY OF THE INVENTION

This invention relates to improvements in roof constructions and methods of making the same, and relates particularly to roof constructions utilizing thermoplastic panels applied over a base layer of insulating material, such as foam panels, or over old roofing material.

Heretofore the common practice in constructing a roof has entailed the use of wood shingles, tiles, slate, or asphalt impregnated and coated felt or other fibrous sheet materials, or the use of roll roofing. The application of separate shingles, whether of wood, slate, tile, or asphalt impregnated and coated material, is laborious and time consuming. Elongated asphalt coated and impregnated sheets known as roll roofing can be applied more rapidly than individual shingles, but application thereof has presented problems of effective anchorage of the sheets, sealing of the joints between sheets, and difficulty of repair in the event an opening is formed in a sheet, as by dropping of an overhanging tree limb upon the roof, or as occasioned by walking upon or working upon a previously applied roof. A further problem with prior types of roofs has been difficulty encountered in the assembly of roofing material and insulating material in juxtaposition as distinguished from the usual practice of installation of insulation separately, as above a ceiling in the space between the ceiling and the roof of a building.

It is the primary object of this invention to provide a roof covered by thermoplastic panels resistant to climatic and solar conditions, wherein the panels are firmly anchored to a building and are effectively sealed at all joints between panels.

A further object is to provide a roof construction which avoids the use of nails or other securing members driven through the roofing panels.

A further object is to provide a building roof formed of edge-engaging panels of foam insulation materials spanning roof rafters and covered with thermoplastic panels firmly anchored to the roof rafters, in which adjacent thermoplastic panels are continuously marginally united to form a unitary imperforate exterior roof cover.

A further object is to provide a novel method of constructing a roof to provide a continuous imperforate external weather-resistant protective thermoplastic cover.

A further object is to provide a novel method of anchoring thermoplastic panels forming an exterior roofing cover to building rafters without the use of securing members which penetrate or pierce the cover-forming thermoplastic panels thereof.

A further object is to provide a roof utilizing foam panels in edge contact spanned by thermoplastic panels bonded at all sheet margins, which roof is characterized by novel foam edge protecting means and by a novel gutter construction.

Other objects will be apparent from the following specification.

BRIEF DESCRIPTION OF THE DRAWING

FIG. 8 is an enlarged sectional view taken on line 8—8 of FIG. 1.

FIG. 9 is an enlarged sectional view taken on line 9—9 of FIG. 1.

DESCRIPTION OF THE PREFERRED EMBODIMENTS

Figure 1:
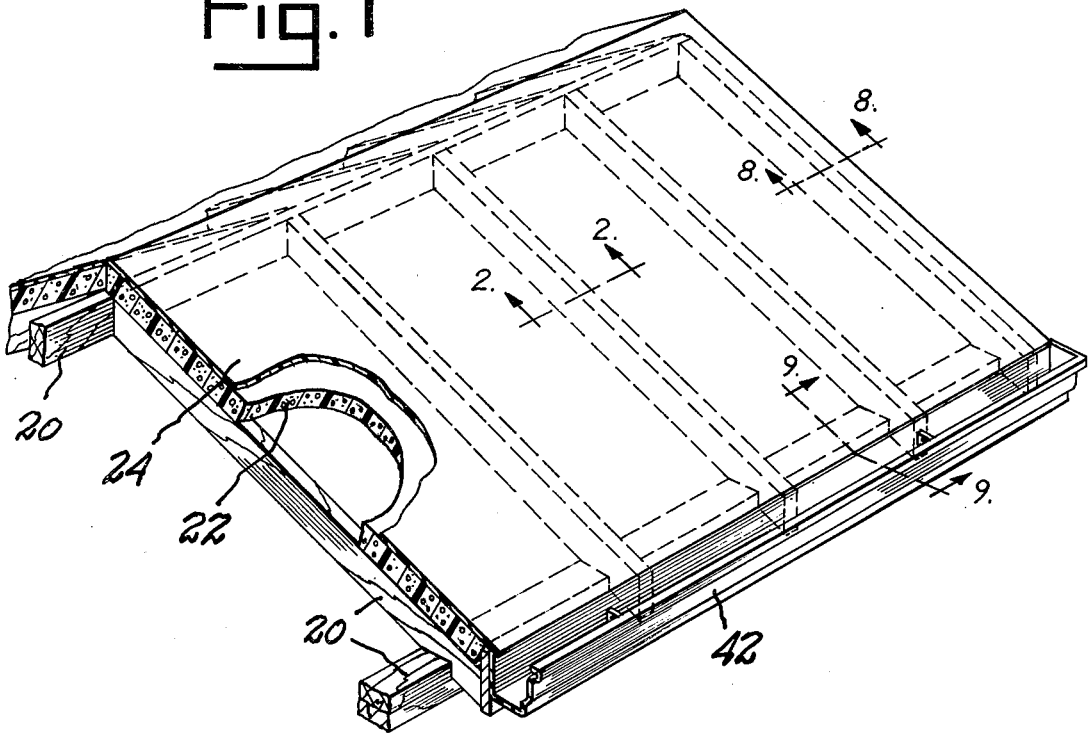
FIG. 1 is a fragmentary perspective view of a roof construction
Figure 2:
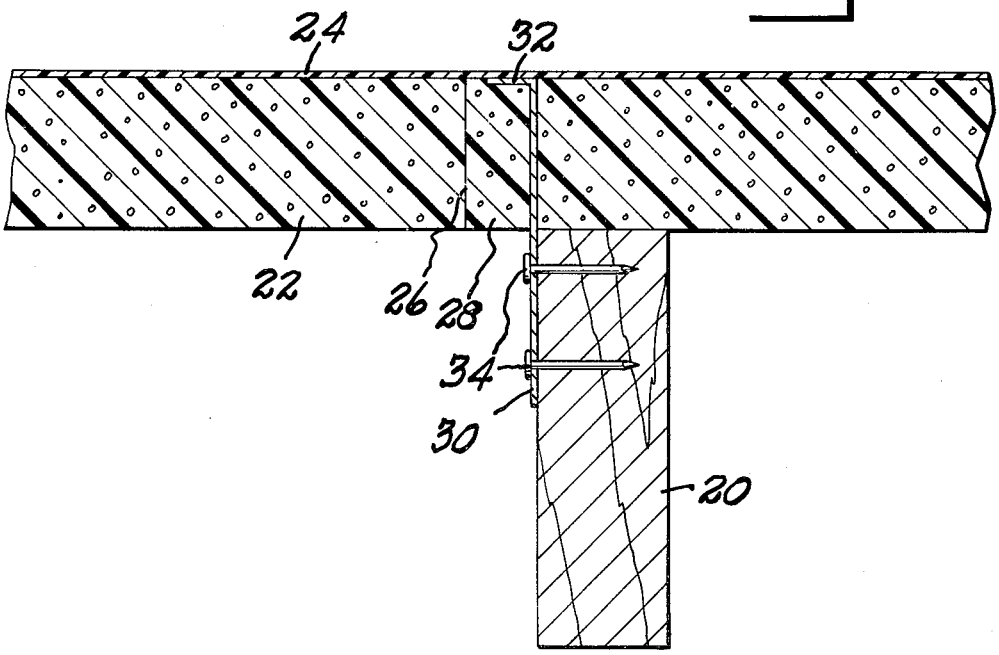
FIG. 2 is an enlarged detail sectional view taken on line 2—2 of FIG. 1.
Figure 3:
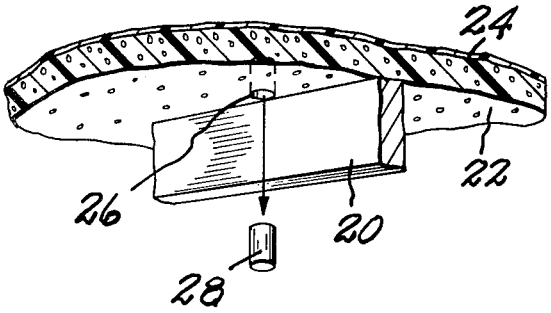
FIG. 3 is a detail perspective view illustrating one step in the method of constructing a roof.
Figure 4:
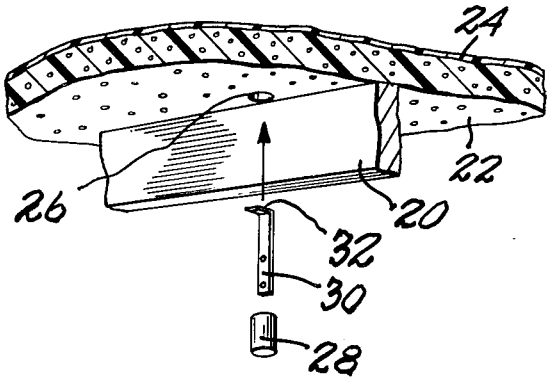
FIG. 4 is a fragmentary perspective view illustrating another step in the method.
Figure 5:
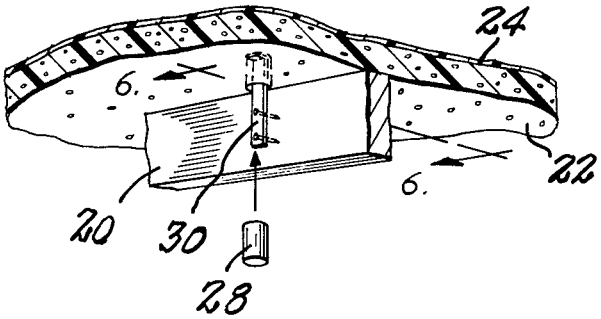
FIG. 5 is a perspective view of another step in the method of constructing a roof.
Figure 6:
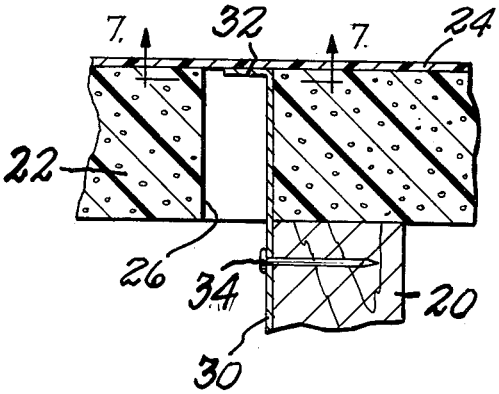
FIG. 6 is an enlarged fragmentary sectional view taken on line 6—6 of FIG. 5.
Figure 7:
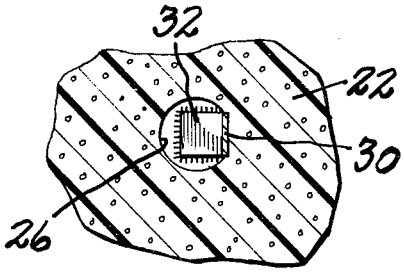
FIG. 7 is an enlarged sectional view taken on line 7—7 of FIG. 6.

I have found that thermoplastic panels, such as high density polyethylene sheet material, high molecular weight polyethylene sheet material and polypropylene sheet material are commercially available which contain additives rendering the same stable in a temperature range from −40° F. to 150° F. and which also render the same impervious to ultra violet attack. The material may also contain fiberglass reinforcement. A typical polyethylene material suitable for roofing is heat formable in a temperature range from 325° F. to 350° F. and is weldable at a temperature in the order of 575° F. A typical usable polyethylene material is also cold formable, although it has a limited plastic memory so that forming thereof to provide surface impressions requires a greater initial depth of impression than desired so as to compensate for the inherent memory action thereof. Materials having these characteristics may be pigmented and may be characterized by translucence. Such materials may also be machinable by the use of wood working tools or metal working tools, and may be cut by the use of a hot wire. Such materials may be flammable, though fire-retardant, and will not sustain combustion. A typical polyethylene material of this character and having the properties is produced by Canadian Industries, Ltd. of Montreal, Canada under the Trademark "Polythene".

This invention contemplates the use of panels of thermoplastic sheet material having the foregoing properties or of fiberglass reinforced sheet material which are utilized in the construction of a roof with or without underlying insulation material or which are utilized in re-roofing.

Referring to FIGS. 1–9 which illustrate my novel roof construction, the numeral 20 designates roof frame members, such as rafters and associated elements. Any suitable roof underpanel members 22 span the roof, being supported upon the rafters and other roof frame members. Panels 22 may be formed of any suitable material, such as wood boards, plywood or closed cell foam polyurethane panels as illustrated herein. The foam panels 22 may be anchored to the rafters and building frame members in any suitable manner and preferably are arranged in edge abutment to completely span the roof. High density polyethylene panels 24 or other suitable thermoplastic panels, with or without fiberglass reinforcement, span and cover the underpanel members 22 to provide a continuous outer or exposed roofing layer. The thermoplastic panels 24 are preferably of a thickness from 0.05 inches to 0.1 inches. Adjacent thermoplastic panels 24 may be arranged in edge abutment or in marginally overlapping relation to adjacent panels.

At spaced points along the rafters 20, anchorage of the thermoplastic panels 24 to the rafters is affected by the construction best illustrated in FIGS. 2–7. Holes 26 may be formed in the panels 22 in any suitable manner. In the event the panel members 22 are formed of polyurethane foam, such holes may be formed by a heated tubular cutter which accommodates removal of a plug 28 of the foam incident to the formation of the hole.

Thermoplastic anchor members 30, preferably formed of the same material as the members 24, are provided for insertion through the holes 26. Members 30 are elongated narrow strips, each having a bent end portion 32 and extend through holes 26. Parts 32 of members 30 are positioned in abutment with the inner surface of the adjacent thermoplastic member 24. Members 30 are of a length greater than the thickness of a panel member 22 so as to project therethrough and into engagement with a roof rafter member 20. Members 30 may be secured to a rafter, as by means of nails 34. The inner upper bent end 32 of each anchor member 30 is heat welded or bonded to the thermoplastic roofing member 24 which it abuts, as by heating the portion of the panel 24, as with a flameless hot air torch directed at the part of each panel 24 which the bent end 32 of an anchor member 30 abuts.

After the thermoplastic panels 24 have been anchored to the roof frame members by the use of the anchor members 30 as above described, the joints between the thermoplastic sheets or panels 24 are sealed. This can be accomplished by a welding operation using a flameless hot air torch to heat bond and continuously seal all joints full length thereof. Welding or bonding of adjacent thermoplastic panels 24 may also be accomplished by the provision of welding strips (not shown) of the same material as panels 24 which are applied at and along each joint between panels and heat flowed and bonded thereto so as to span the joint between adjacent panels and thus effect a seal at and along each joint.

If desired, after connection of the thermoplastic sheets 24 to the roof frame members 20 by means of the anchor members 30, the holes 26 may be filled, as by reinserting the foam plugs 28 into the openings 26 and cementing the plugs in place in the holes. Alternatively, a quantity of foam forming material may be inserted in each hole 26 and caused to react to form a foam filler within each hole.

The same characteristic of the thermoplastic panels 24 which permits bonding thereof to adjacent panels along the seams or joints therebetween and which facilitates securement thereto of the anchors 30 at parts 32 is of importance and a significant advantage in a roof of the construction described in the event an opening or tear is formed which destroys the continuity of the bonded thermoplastic members 24. Thus patch pieces of the thermoplastic material may be applied to span such tears or openings and bonded to the members 24 by heat welding, with a flameless hot air torch.

Figure 12:
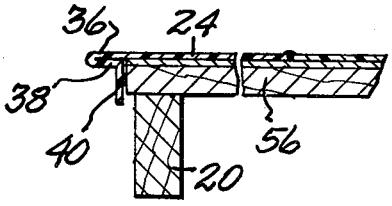
FIG. 12 is an enlarged sectional detail view taken on line 12—12 of FIG. 10.

In instances in which the thermoplastic roofing material 24 is applied over foam panels 22 and it is desired to protect the edges or marginal portions of the foam panels, an arrangement of the character ilustrated in FIG. 8 and FIG. 12 may be utilized. In such instances, the thermoplastic panels 24 located adjacent the edge of the roofing to be protected extend substantially beyond the edge of the underlying panels 22. The projecting portion of each panel is bent to assume a protective position after being heated to permit deforming thereof. As shown in FIGS. 8 and 12, marginal thermoplastic projecting edge portions 36 of panels 24 are return bent downwardly and inwardly at 38 and terminate in protective flanges 40 extending into contact with the edges of adjacent underpanel members 22. The formation of the parts 36, 38 and 40 is preferably accomplished after anchorage of the thermoplastic panels 24 of the roof frame members and after welding of the joints between thermoplastic panels 24. It can be accomplished by heating the projecting portions 36 of the panel; as by the use of a flameless hot air torch, to an extent accommodating reshaping of the thermoplastic members to the desired configuration. Also, if desired, it will be apparent that the heating of projecting panel parts 36 may be sufficient to permit bonding of the parts 36 and 38 so as to rigidify the thermoplastic panels at the roof margins. Also it will be apparent that the flanges 40 may be anchored to the edges of under panels 22, as by the use of cement or securing members.

The thermoplastic roof construction described accommodates the use of gutter members 42 which also preferably are formed of materials similar to that of panels 24. The gutters 42 are characterized by an outer wall 44, a bottom wall 46, an inner wall 48, and an angularly extending flange 50 projecting angularly upwardly from the upper margin and along the length of the inner wall 48. Each gutter 42 may be provided with spaced transverse apertured spacers or shape retaining members 52 at intervals along its length. Installation of the gutters 42 is preferably accomplished after anchorage of panels 24 to the roof frame members and after seam bonding of adjacent panels has been completed. This is accomplished in the construction shown in FIG. 9 by inserting the gutter flange 50 under the marginal edge of the adjacent thermoplastic panels 24, as between the thermoplastic panels 24 and the under panels 22, to a position at which the inner wall 48 of the gutter abuts a roofing frame member or a fascia panel 54. If desired, the gutter wall 48 is nailed or otherwise secured at spaced points to the fascia member 54. Also, bonding of the flange 50 to the thermoplastic panels 24 along the length of the gutter member may be done by applying heat to the overlying parts of panels 24.

Figure 10:
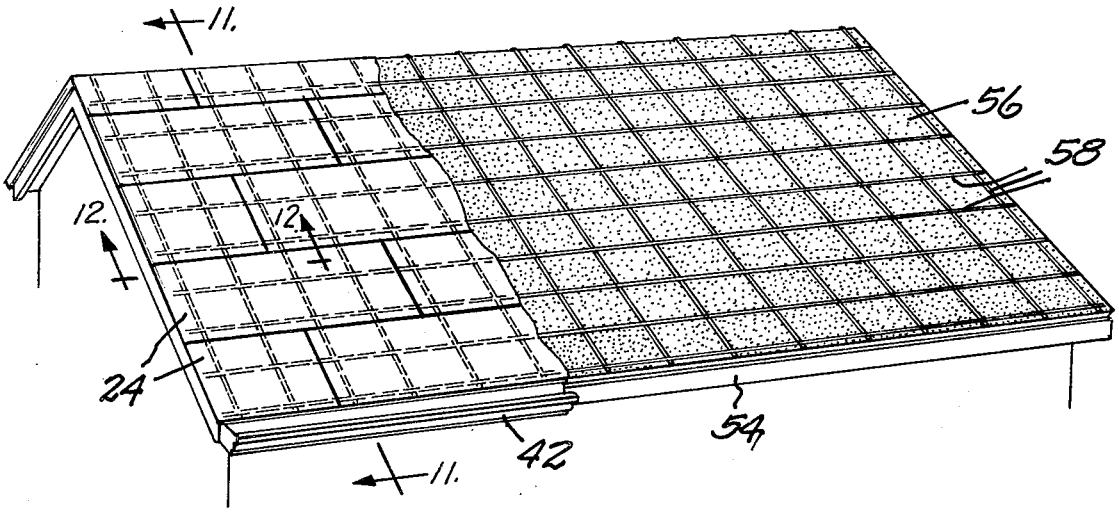
FIG. 10 is a fragmentary perspective view illustrating a method of re-roofing a building.
Figure 11:
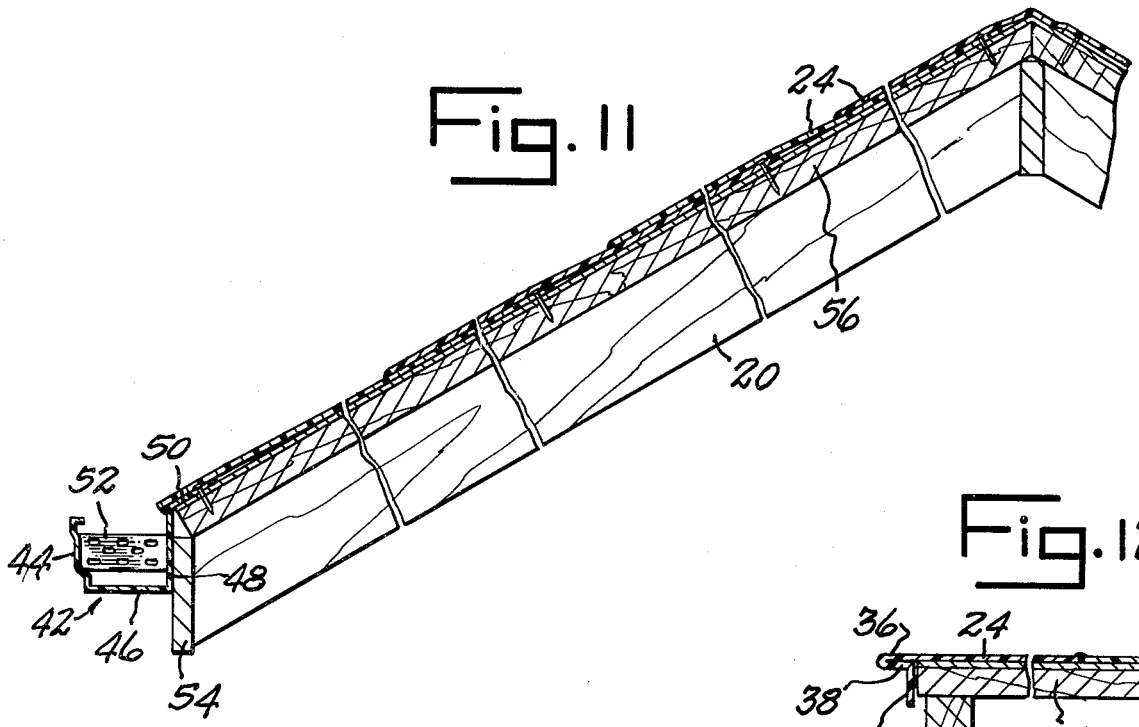
FIG. 11 is an enlarged sectional detail view taken on line 11—11 of FIG. 10.

The application of thermoplastic roofing panels 24 to a roof in a re-roofing operation is illustrated in FIGS. 10–12. The operation entails the formation of holes in the prior roofing material 56 alongside roof rafters 20 as illustrated in FIGS. 3–7, and the application of cement or adhesives in intersecting lines 58 on the outer surface of the prior roofing material 56. The thermoplastic roof panels 24 are then applied in desired relation, as in the overlapping relation seen in FIG. 11 at horizontal joints and in edge abutment in the same horizontal course. The panels 24 are held in place by the cement 58. The lines of cement 58 are preferably spaced apart distances less than the overall dimensions of a thermoplastic panel 24 so that each panel 24 will be adhered to the prior roofing material at spaced intersecting linear points. Anchor strips 30, similar to those illustrated in FIGS. 4–7, may be positioned in the openings in the prior roof and then heat bonded or welded to the inner faces of the adjacent thermoplastic panels 24. Anchor strips 30 are nailed or otherwise anchored to a roof frame member 20 as above described. The thermoplastic panels 24 are then bonded together by heating the same along the seams or joints therebetween in the manner previously described, thereby forming a continuous thermoplastic re-roof structure. The thermoplastic panels at roof margins may then be formed to reinforce the same and to protect the edge of the prior roofing as illustrated in FIG. 12, as by formation of parts 36, 38 and 40 as previously described. Also, gutters 42 may be applied along the eaves of a building as previously described and as illustrated in FIG. 11.

While the use of high density or high molecular weight polyethylene sheet material reinforced with fiberglass as produced by Canadian Industries, Ltd. of Montreal, Canada under the Trademark "Polythene" is preferred, other thermoplastic materials may be utilized which possess following requisite properties: Stability in a temperature range from −40° F. to 150° F., imperviousness to ultra violet or solar attack; bonding to like material by the application of heat; forming ability at temperatures in a range from 325° F. to 350° F. or more; weldability at temperatures in the order of 525° F. to 625° F.; ready machinability and severability; and fire retardance and resistance to sustained combustion.

The resultant roof produced as above described, either in new construction or for re-roofing, is characterized by firm anchorage of thermoplastic panels throughout the area of the roof; imperforate character throughout the entire area of the roof; ready and inexpensive repair in the event of penetration of the roof by accident or for other causes; strong protective flanged margins at roof edges; and novel integrated anchorage of gutters along eaves. The construction also accommodates integrated installation of insulation with thermoplastic imperforate roofing material. The thermoplastic roof panels may be of any selected size for convenience of handling and installation, for example, panels of a size in the order of four feet or less in width and eight feet or less in length. If desired to facilitate application, the panels may be nailed in place for initial anchorage thereof, and the nails heads may be covered or spanned by thermoplastic patches bonded thereto to insure against leakage at nail points.

While the preferred embodiment of the roof construction and the method of making it have been illustrated and described, it will be understood that changes thereof within the scope of the appended claims may be made without departing from the spirit of the invention.

What I claim is:

1. In a building roof having a roof frame and roof underpanel members carried by said frame, the improvement comprising a plurality of thermoplastic panels arranged in marginally contacting relation and spanning said roof, and a plurality of spaced thermoplastic anchor members attached to and depending from said panels and extending through said underpanels with their lower ends projecting below said underpanels and secured directly to said frame to provide anchorage of said thermoplastic panels to said roof, said thermoplastic panels being bonded together along their margins.

2. A building roof as defined in claim 1, wherein said anchor members are bonded to said panels at the bottom surfaces of said panels.

3. A building roof as defined in claim 1, wherein said thermoplastic panels are of a thickness in the range of 0.045" to 0.105".

4. A building roof as defined in claim 1, and thermoplastic gutters at roof eaves, said gutters having marginal flanges underlying and bonded to adjacent margins of said thermoplastic panels.

5. A building roof construction comprising members forming a roof frame, foam insulation panels spanning said roof frame; a plurality of thermoplastic roof panels spanning said insulation panels and bonded together at abutting margins thereof to define a continuous imperforate roof covering, and a plurality of spaced thermoplastic anchor members bonded to said thermoplastic panels and extending downwardly therefrom and through said insulation panels and alongside and secured to roof frame members.

6. A building roof as defined in claim 1, wherein said thermoplastic panels are characterized by stability in a temperature range at least −40° F. to 150° F., and resistance to ultraviolet attack.

7. A building roof as defined in claim 6, wherein said thermoplastic panels are characterized by heat formability in a temperature range of at least 300° F. to 375° F., are weldable in a temperature range between 550° F. and 600° F., and will not sustain combustion.

8. A building roof as defined in claim 1, wherein portions of said thermoplastic panels at the edges of the roof include downturned flanges along selected edges of underpanel members.

9. A building roof as defined in claim 8, wherein said roof edge flange portions project downwardly and are inset from return bent portions extending outwardly and laterally relative to the underpanels.

* * * * *